United States Patent [19]

Smith

[11] Patent Number: 4,632,636

[45] Date of Patent: Dec. 30, 1986

[54] PROPELLER WITH BLADES HAVING REGRESSIVE PITCH

[75] Inventor: William H. Smith, Warren, Mich.

[73] Assignee: Edward H. Smith, Port Charlotte, Fla.

[21] Appl. No.: 498,931

[22] Filed: May 27, 1983

[51] Int. Cl.[4] ..... B63H 1/26

[52] U.S. Cl. ..... 416/223 R; 416/235; 416/243; 416/DIG. 2

[58] Field of Search ..... 416/223 A, 223 R, 235, 416/242, DIG. 2, 239, 243

[56] References Cited

U.S. PATENT DOCUMENTS

| | | | |
|---|---|---|---|
| 535,271 | 3/1895 | Armstrong | 416/242 X |
| 1,030,047 | 6/1912 | Ames | 416/238 |
| 1,582,978 | 5/1926 | Grilli | 416/223 R |
| 2,754,919 | 7/1956 | Blue | 416/238 |
| 2,978,040 | 4/1961 | Wirkkala | 416/235 X |
| 3,635,590 | 1/1972 | Phillips | 416/223 R X |

FOREIGN PATENT DOCUMENTS

| | | | |
|---|---|---|---|
| 7921 | of 1908 | United Kingdom | 416/235 |
| 24066 | of 1915 | United Kingdom | 416/235 |
| 8825 | 5/1982 | United Kingdom | 416/235 |

*Primary Examiner*—Robert L. Garrett
*Assistant Examiner*—Joseph M. Pitko
*Attorney, Agent, or Firm*—Harold W. Milton, Jr.

[57] ABSTRACT

A propeller (10) including a hub (12) and a plurality of blades (16) having a leading edge (22), outside edge (24), tail edge (26) and inside edge (28). Each of the blades (16) extend substantially radially from the hub (12) and include a body portion having a regressive pitch from the leading edge (22) to the tail edge (26) and cupped portions (30) and (32) extending along the inside edge (28) and outside edge (24), respectively. A method of making the propeller (10) includes the steps of forming the hub (12) and forming the plurality of blades (16) having a regressive pitch and extending substantially radially from the hub and forming the first cupped portion (30) extending along the inside edge (28) and the second cupped portion (32) extending along the outside edge (24).

27 Claims, 6 Drawing Figures

PROPELLER WITH BLADES HAVING REGRESSIVE PITCH

TECHNICAL FIELD

The instant invention relates to propellers for boats.

BACKGROUND ART

The shape and curvature of the blades of a boat propeller significantly influence the performance of the propeller. Such a blade is designed to hold the water on the working face of the blade to create a force against the water to create a forward thrust. The working surface of the blade is that surface working against the water. A greater force is produced by utilizing a greater portion of the working surface of the blade. However, prior art propellers, which are spoon or dish shaped and have progressive pitch, produce a great amount of resistance to water flow over the blade and, consequently, a terribly choppy ride. This effect is most profound during quick accelerations. Examples of propellers having completely or, in part, progressive pitch are disclosed in U.S. Pat. Nos. 1,030,047 to Ames and 2,754,919 to Blue.

The instant invention provides a significant improvement over the prior art by providing a propeller having a regressive pitch, the regressive pitch extending from the leading edge to the tail edge of each blade. The propeller having the regressive pitch produces a significant decrease in the resistance to water flowing over each of the blades of the propeller. Instead of restricting water flow, the blades having a regressive pitch cut through the water. Additionally , the blades are vented to control the water flow over the blades. The venting holds the water on the blades and directs the water flow. The maximum amount of the working surface of the blade is used, thereby increasing the efficiency of the propeller significantly. The instant invention results in increased acceleration with a concurrently significant decrease in agitation of the boat.

STATEMENT OF THE INVENTION

In accordance with the present invention, there is provided a propeller including a hub and a plurality of blades extending substantially radially from the hub. Each of the blades includes a body portion having a regressive pitch.

The instant invention further provides a method of making the propeller including the steps of forming the hub and forming a plurality of blades having a regressive pitch and extending substantially radially from the hub.

FIGURES IN THE DRAWINGS

An embodiment of the propeller constructed in accordance with the present invention will now be described by way of example only, with reference to the accompanying drawings in which.

DETAILED DESCRIPTION OF THE DRAWINGS

Referring to the FIGURES, a propeller constructed in accordance with the instant invention is generally shown at 10. The propeller 10 includes a hub 12 which includes a plurality of radially inwardly extending teeth 14 for engaging the drive shaft upon which the propeller 10 is mounted. The hub 12 is generally cylindrical and may be secured to the drive shaft by a nut or other means commonly used in the art. Other hubs, such as those having a tapered bore, may be used.

Figure 2:
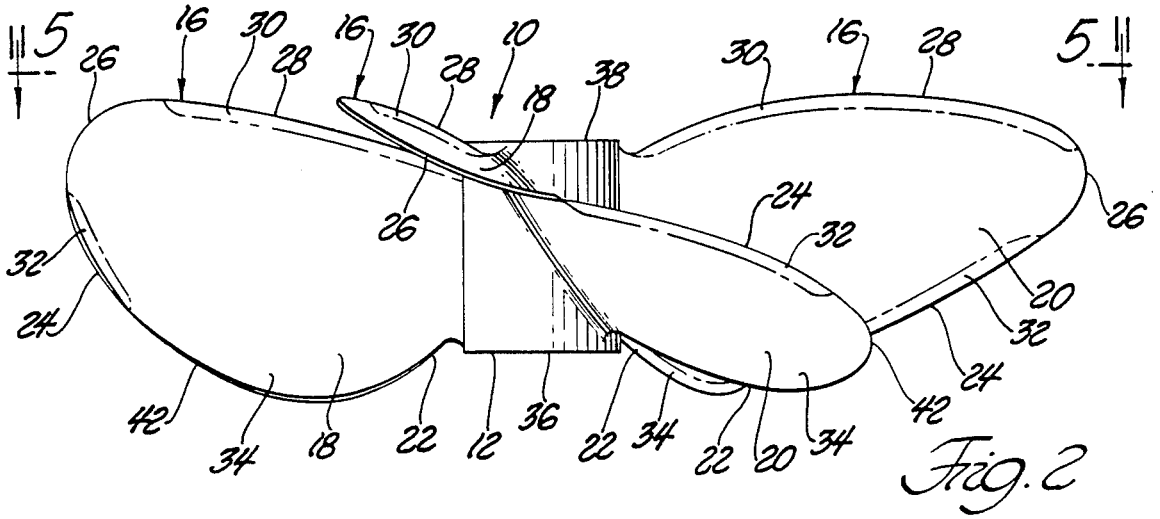
FIG. 2 is an elevational view taken substantially along lines 2—2 of FIG. 1.
Figure 3:
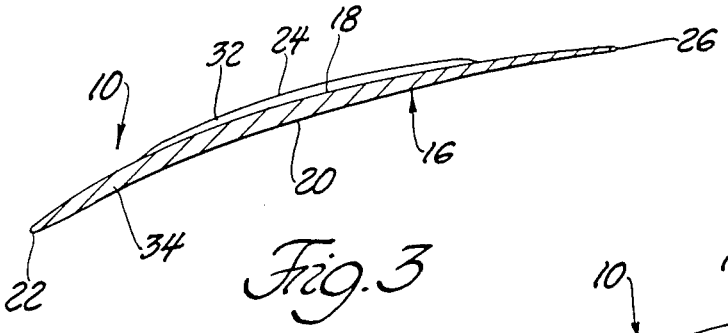
FIG. 3 is a cross-sectional view taken substantially along lines 3—3 of FIG. 1.
Figure 4:
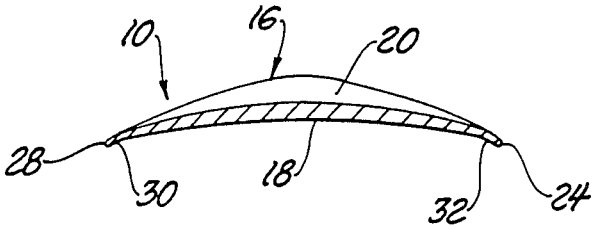
FIG. 4 is a cross-sectional view taken substantially along lines 4—4 of FIG. 1.

The propeller 10 includes a plurality of blades generally indicated at 16. Each of the blades 16 includes a body portion having a regressive pitch as best shown in FIGS. 2 and 3. To further explain, the body portion of each blade 16 has a working surface 18 which is continually working against the water to create the moving force of the propeller and an opposite face 20. Each of the blades 16 includes a leading edge 22 extending from the hub 12, an outside edge 24 extending from the leading edge 22, a tail edge 26 extending from the outside edge 24, and an inside edge 28 extending between the tail edge 26 and the hub 12. The regressive pitch of each blade 16 is such that the angle of the working face 18 of each blade 16 extends from the leading edge 22 and continually falls away from the leading edge 22 to the tail edge 26 so that as the leading edge 22 cuts an imaginary helix during rotation about the center axis, successive next adjacent positions on the working face from the leading edge 22 to the tail edge 26 cut imaginary helixes with progressively decreasing lead angles relative to the center axis., as illustrated in cross section in FIG. 3. Unlike blades of propellers having a progressive pitch, the leading edge 22 of the blade 16 having a regressive pitch cuts through the water with a significant decrease in resistance to the water flow over each blade 16. Therefore, unlike prior art blades which cause a great deal of agitation to a boat during a quick acceleration, the regressively pitched blade 16 of the instant invention provides a much smoother acceleration.

As shown in FIGS. 2 and 3, each of the blades 16 is continually curved from the leading edge 22 to the tail edge 26 to define the regressive pitch. The regressive pitch in angular degrees decreases from the leading edge 22 to the tail edge 26. Preferably, the decrease in angular degrees of pitch is within a range of 4°. However, the amount of decrease depends upon factors related to the structure of the boat. Hence, the range may be broadened.

Each of the blades 16 includes flow control means for directing the flow of water in the direction of the regression of each of the blades 16. More specifically, the flow control means includes a first cupped portion 30 extending along the inside edge 28 of each of the blades 16 and a second cupped portion 32 extending along each of the outside edges 24. Preferably, each of the cupped portions 30 and 32 have an equal inner diameter. Each cupped portion 30, 32 defines the roller outer periphery thereby forming the vent means therebetween. The vent means extends from the leading edge 22 to the tail edge 26 of each of the blades 16. Hence, there is a negative dip from the leading edge 22 to the tail edge 26 in the form of a vent defined by the cupped portions 30 and 32 and the working surface 18 of the body of each of the blades 16.

In use, as the leading edge 22 of each blade 16 cuts into the water, the cupped portions 30 and 32 control the water flow over the working surface 18 of each blade 16 to prevent the water from escaping from the helix defined by the blades 16 of the propeller 10. The cupped portions 30 and 32 force the water to flow along the entire working surface 18 of each blade 16 and into the body portion of each blade 16 as opposed to flowing off the outside edge 24. It has been found that this construction of the instant invention provides significant improvement over prior art propellers by initially causing a high torque energy transfer to the water. There is an apparent load placed on the entire blade 16 resulting in the high torque energy transfer. The combination of the regressive pitch blades 16 and the vent means comprising the cupped portions 30 and 32 provide a propeller 10 which is extremely effective during quick accelerations yet provides a smooth ride within the boat upon which the propeller 10 is mounted.

The leading ede 22 of each blade 16 defines the extremity of a heel portion 34 of each blade 16. The hub 12 has a front end face 36 and rear end face 38. As best shown in FIG. 2, the heel portion (34) extends from the hub 12 radially outwardly and forwardly of the front end face 36 of the hub 12. Hence, the heel 34 of each blade 16 is forward relative to the front face 36 of the hub 12. This specific configuration of the heel portion 34 of each blade 16 has been found to produce increased efficiency of the propeller 10 during acceleration.

Figure 1:
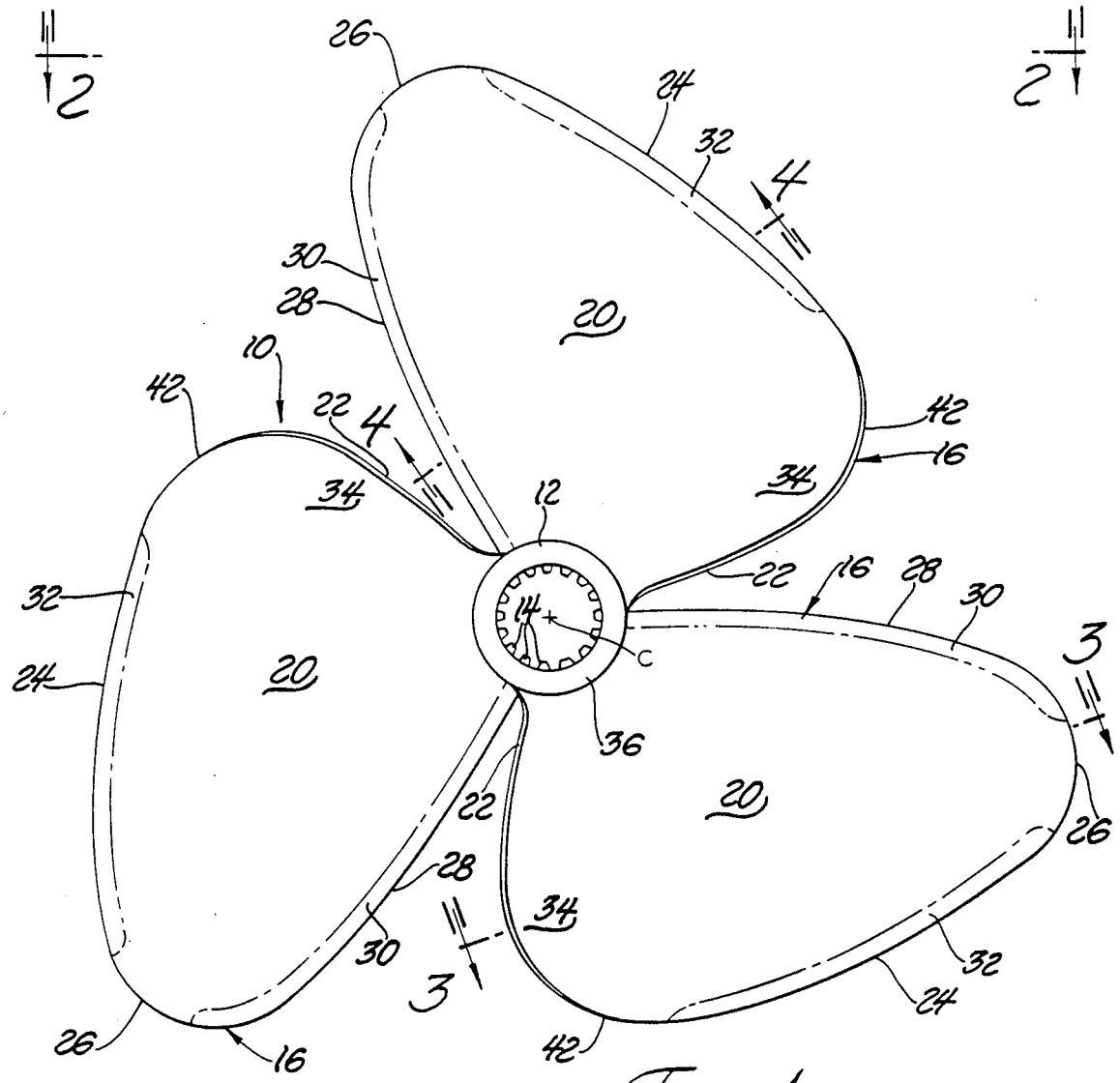
FIG. 1 is a top plan view of the instant invention.
Figure 5:
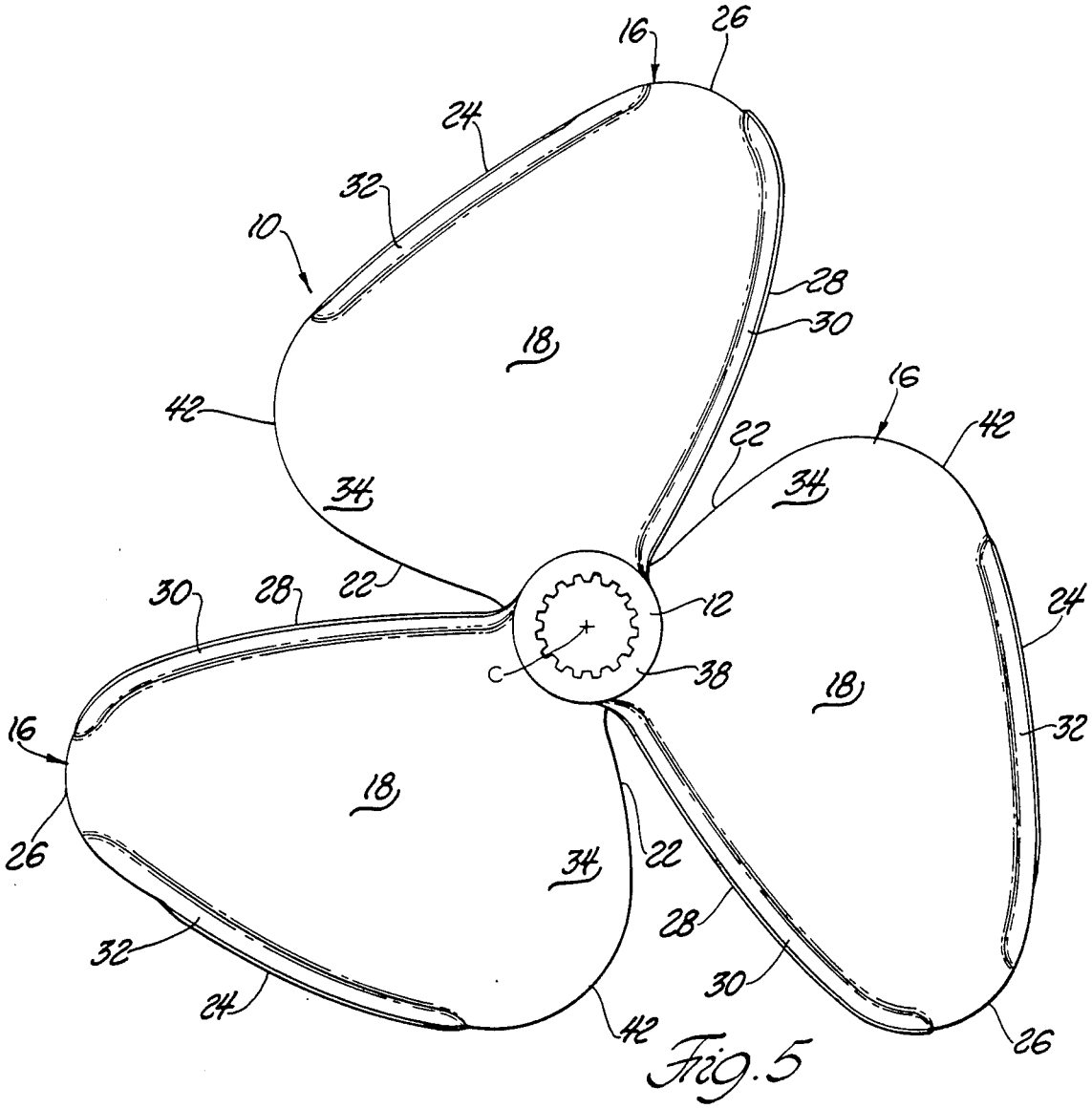
FIG. 5 is a bottom plan view taken substantially along lines 5—5 of FIG. 2.
Figure 6:
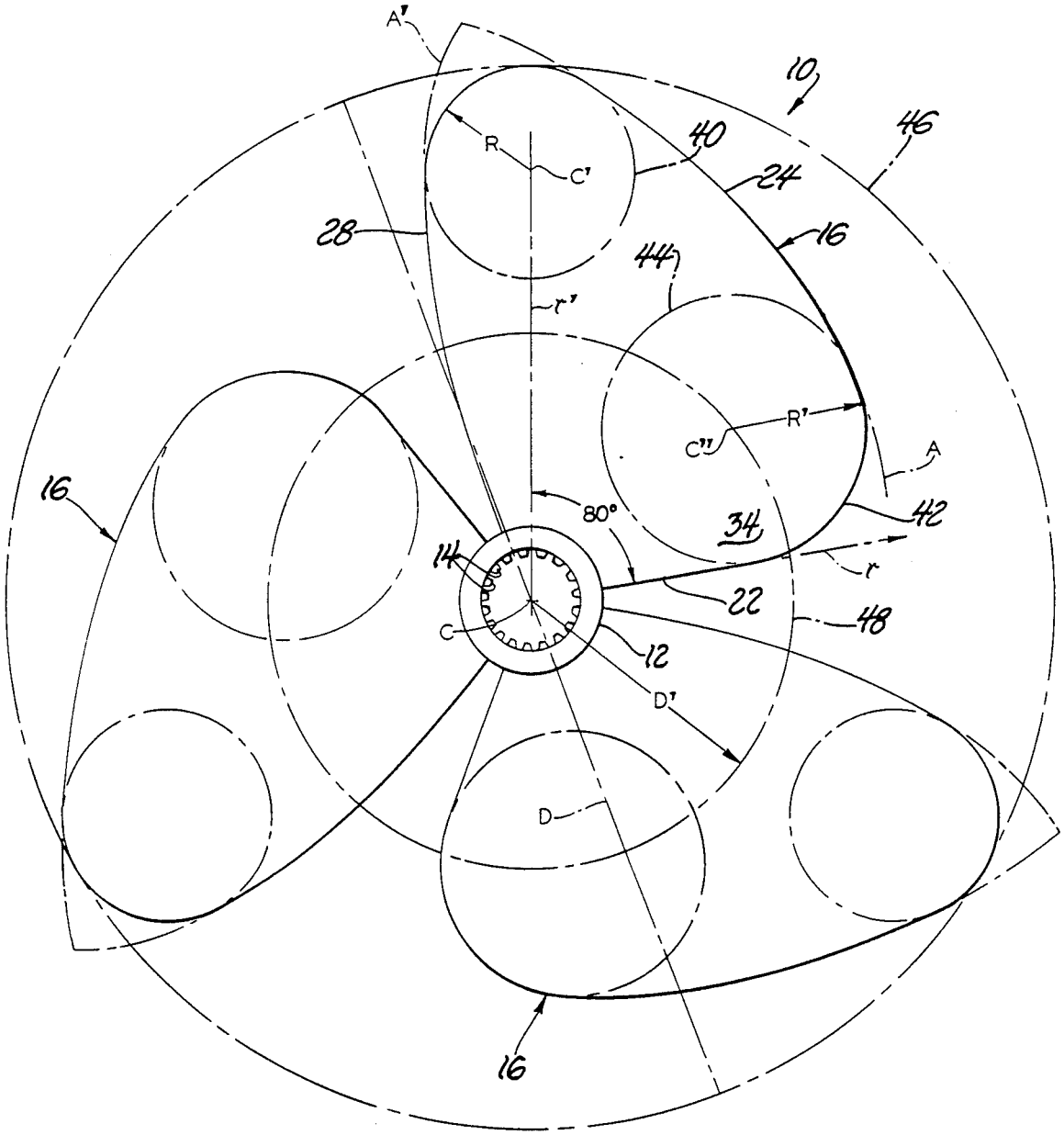
FIG. 6 is a plan view of the instat invention prior to forming the regressive pitch in each of the blades thereof.

The combination of the regressive pitch of each blade 16, the cupped portions 30 and 32 defining the vent means of each blade 16 and the specific shape of each blade 16 is significant in regard to the total performance of the propeller 10. The specific shape of each blade 16 also contributes to the effectiveness of the instant invention. FIG. 6 shows the shape of the propeller blade 16 prior to forming the regressive pitch and vent means in each blade. The tail edge 26 of each blade 16 follows an arcuate curve defined by a tail edge circle shown in phantom at 40. Each blade 16 has a transition edge 42 extending arcuately between the leading edge 22 and the outside edge 24. The transition edge 42 of each blade 16 is on the circumference of a heel circle shown in phantom at 44. In other words, each of the tail edges 26 follows the cirumference of a tail edge circle 40 and each of the transition edges 42 follow the circumference of the heel circle 44. As the entirety of the propeller 10 defines a propeller circle 46, each of the tail edge circles 40 are tangent to the propeller circle 46 having the center axis C which coincides with the center axis of the hub 12. Each leading edge 22 extends into a transition edge 42 following the heel circle 44. Each heel circle 44 has a radius R′ which is larger than the radius R of the tail edge circle 40. Because of this relationship, the distance between the outside and inside edges 24 and 28, respectively, is greater adjacent the leading edge 22 than adjacent the tail edge 26. In other words, each blade 16 has an apparent taper from the leading edge 22 to the tail edge 26. As shown in FIGS. 1, 5 and 6, the leading edge 22 extends substantially radially from the hub 12. As shown in FIGS. 1 and 5, the cupped portion 30 on the inside edge 28 of each blade 16 extends at least 50 to 55% into the tail edge 26 defined by the tail edge circle 40. Preferably, the cupped portions 30 extend greater than or equal to 80% of the tail edge circle 44. It has been found that the increased amount of the cupped portions 30 and 32 are directly proportional to an increased rpm output from the engine of the boat. In other words, the extent of the cupping of the blade 16 results in an increased efficiency of performance of the propeller 10.

The instant invention is made by forming the hub 12 and a plurality of blades 16 having the regressive pitch and extending substantially radially from the hub 12. The first cupped portion 30 is formed along the inside edge 28 and the second cupped portion 32 is formed along the outside edge 24. The leading edge 22 of each blade 16 is formed to extend from the hub 12 radially outwardly and forwardly of the front end face 36 of the hub 12. Each blade 16 is continually curved from the leading edge 22 to the tail edge 26 to define the regressive pitch of each blade 16. The curving of the regressive pitch of the blade 16 is decreased in angular degrees from the leading edge 22 to the trailing edge 26. Preferably, the regressive pitch is decreaed in angular degrees within a range of 4°. As stated above, the range may be broader. The tail edge 26 is formed to follow an arcuate curve defined by the tail edge circle 40. The arcuate transition edge 42 if formed between the leading edge 22 and the outside edge 24. Each of the tail edge circles 40 are tangential to the propeller circle 46 which has the axis of the hub 12 as its center C. The leading edge 22 is formed on the heel circle 44 having a greater radius R′ than the radius R of the tail edge circles 44 whereby the distance between the outside edge 24 and inside edge 28 is greater adjacent the leading edge 22 than the tail edge 26. The leading edge 22 is formed to extend substantially radially from the hub 12. Each of the cupped portions 30, 32 is formed to intersect the circumference of the tail edge circle 40. Finally, the cupped portions 30, 32 are formed to have substantially the same but opposite cross-sectional shapes.

The specific formula for forming the shape of each of the blades 16, as shown in FIG. 6, is as follows: First, the propeller circle 46 is formed having a diameter D about the center C. The propeller circle 46 is radially trisected by radials 120° apart. Each of the blades 16 is formed by forming the tail edge circle 40 having a radius R about a center C′ and tangent to the propeller circle 46 wherein $R=1/10D$. The center C′ is on the radial r. A mean circle 48 is formed having a diameter D′ and the center C wherein $D'=\frac{1}{2}D$. The heel circle 44 is formed tangent to a radial r extending from the center C which is 80° from a radial r′. The heel circle 44 is formed having a center C″ on the mean circle 48 and having a radius R′ wherein $R'=\frac{1}{8}D$. The outside edge 24 is formed on an arc A which is tangent to both the heel circle 44 and the tail edge circle 40. The arc A has a radius R″ wherein $R''=\frac{3}{4}D$. The inside edge 28 is formed on an arc A′ which is tangent to the tail edge circle 40 and intersects the center C, the arc A′ having a radius $R'''=\frac{3}{4}D$. The leading edge 22 is formed on the radial r extending from the center C.

The invention has been described in an illustrative manner, and it is to be understood that the terminology which has been used is intended to be in the nature of words of description rather than of limitation.

Obviously, many modifications and variations of the present invention are possible in light of the above techings. It is, therefore, to be understood that within the scope of the appended claims wherein reference numerals are merely for convenience and are not to be in any way limiting, the invention may be practiced otherwise than as specifically described.

The embodiments of the invention in which an exclusive property or privilege is claimed are defined as follows:

1. A propeller (10) comprising: a hub (12) having a center axis and a plurality of blades (16) extending substantially radially from said hub (12), each blade (16) having a leading edge (22), a tail edge (26), and a working face (20) on one side of said blade (16), characterized by each of said blades (16) including a body portion including said working face (20) having a regressive pitch that continually falls away from said leading edge (22) to said tail edge (26 so that as said leading edge (22) cuts an imaginary helix during rotation about the center axis, successive next adjacent positions on said working face from said leading edge (22) to said tail edge (26) cut imaginary helixes with progressively decreasing lead angles relative to the center axis.

2. A propeller as set forth in claim 1 further characterized by each of said blades (16) including flow control means for directing the flow of water in the direction of the regression of said blades (16).

3. A propeller as set forth in claim 2 further characterized by each of said blades (16) including an outside edge (24) extending from said leading edge (22), said tail edge (26) extending from said outside edge (24), and each of said blades (16) including an inside edge (28) extending between said tail edge (26) and said hub (12), said flow control means including a first cupped portion (30) extending along said inside edge (28) and a second cupped portion (32) extending along said outside edges (24).

4. A propeller as set forth in claim 3 further characterized by said leading edge (22) defining an extremity of a heel portion (34) of said blade (16), said hub (12) having front and rear end faces (36, 38), said heel portion (34) extending from said hub (12) radially outwardly and forwardly of said front end face (36) of said hub (12).

5. A propeller as set forth in claim 4 further characterized by said regressive pitch decreasing in angular degrees from said leading edge (22) to said tail edge (26).

6. A propeller as set forth in claim 5 further characterized by said decrease in angular degrees of pitch being within a range of four degrees.

7. A propeller as set forth in claim 5 further characterized by said tail edge (26) following an arcuate curve.

8. A propeller as set forth in claim 7 further characterized by said blade (16) having a transition edge (42) extending arcuately between said leading edge (22) and said outside edge (24).

9. A propeller as set forth in claim 8 further characterized by said tail edge (26) following the circumference of a tail edge circle (40) having a radius R and center C', each of said tail edge circles (40) being tangent to a propeller circle (46) having a diameter D and a center on axis (C) which coincides with the center axis of said hub (12).

10. A propeller as set forth in claim 9 further characterized by said transition edge (42) following a heel circle (44), said heel circle (44) having a center C'' and a radius R' larger than the radius R of said tail edge circle (40) whereby the distance between the outside and inside edges (24, 28) is greater adjacent said leading edge (22) than said tail edge (26).

11. A propeller as set forth in claim 10 further characterized by said leading edge (22) extending substantially radially from said hub (12).

12. A propeller as set forth in claim 11 further characterized by each of said cupped portions (30, 32) intersecting the circumference of said tail edge circle (40).

13. A propeller as set forth in claim 12 further characterized by each of said cupped portions (30, 32) having substantially the same but opposite cross-sectional shapes.

14. A propeller as set forth in claim 13 further characterized by said propeller circle (46) including three radials r extending radially from said center C and trisecting said propeller circle (46), said center C' of said tail edge circle (40) being on said radial r wherein $R=1/10D$, said propeller (10) including a mean circle (48) having a diameter D' and a center on said center C wherein $D'=\frac{1}{2}D$, said propeller (10) further including three radials r extending radially from said center C and being 80° from each respective radial r; said leading edge (22) of each of said blades being in a respective radial r, said center C'' of said heel circle (44) being on said mean circle (48) wherein $R'=\frac{1}{8}D$, said outside edge (24) being on an arc A' which is tangent to said heel circle (44) and tail edge circle (40), said arc A having a radius R'' wherein $R''=\frac{3}{4}D$, and said inside edge (28) being on an arc A' which is tangent to said tail edge circle (40) and passes through said center C, said arc A' having a radius R''' wherein $R'''=\frac{3}{4}D$.

15. A method of making a propeller (10) including the steps of; forming a hub (12) having a center axis and a plurality of blades (16) each having a leading edge (22) and a tail edge (26) and a working face (20) with each of said blades extending substantially radially from the hub (12) and continually curving the working face (20) of each blade (16) from the leading edge (22) to the tail edge (26) to define a regressive pitch of the blade (16) so that as the leading edge (22) cuts an imaginary helix during rotation about the center axis, successive next adjacent positions on the working face from the leading edge (22) to the tail edge (26) cut imaginary helixes with progressively decreasing lead angles relative to the center axis.

16. A method as set forth in claim 15 wherein each blade (16) includes a leading edge (22) extending from the hub (12), an outside edge (24) extending from the leading edge (22), a tail edge (26) extending from the outside edge (24) and an inner edge (28) extending between the tail edge (26) and the hub (12), said method further including the step of forming a first cupped portion (30) along the inside edge (28) and a second cupped portion (32) extending along the outside edge (24).

17. A method as set forth in claim 16 wherein the leading edge (22) defines the extremity of a heel portion (34) of the blade (16), the hub (12) having front and rear end faces (36, 38), said method further including the steps of forming each leading edge (22) to extend from the hub (12) radially outwardly and forwardly of the front end face (36) of the hub (12).

18. A method as set forth in claim 17 further defined by decreasing in angular degrees the regressive pitch of each of the blades (16) from the leading edge (22) to the tail edge (26).

19. A method as set forth in claim 17 further defined by decreasing the regressive pitch in angular degrees within a range of four degrees.

20. A method as set forth in claim 18 further including the step of forming the tail edge (26) to follow an arcuate curve.

21. A method as set forth in claim 20 further including the step of forming an arcuate transition edge (42) between the leading edge (22) and the outside edge (24).

22. A method as set forth in claim 21 wherein each of the blades includes a tail edge circle (40) having a radius R and center C' and being tangent to a propeller circle (46) having a diameter D and a center on axis C which coincides with the center axis of the heels (12), said method further including the steps of forming the tail edge (26) upon the circumference of the tail edge circle (40).

23. A method as set forth in claim 22 further including the steps of forming the transition edge (42) on a heel circle (44) having a center C'', radius R' greater than the radius R of the tail edge circle (44) whereby the distance between the outside edge (24) and the inside edge (28) is greater adjacent the leading edge (22) than the tail edge (26).

24. A method as set forth in claim 23 further including the step of forming the leading edge (22) to extend substantially radially from the hub (12).

25. A method as set forth in claim 24 further including the step of forming each of the cupped portions (30, 32) to intersect the circumference of each respective tail edge circle (40).

26. A method as set forth in claim 25 further including forming the cupped portions (30, 32) to have substantially the same but opposite cross-sectional shapes.

27. A method as set forth in claim 26 wherein the shape of each blade (16) is initially formed by including the steps of; trisecting the propeller circle (46) by radials r' extending radially from the center C, forming the center C' of the tail edge circle (40) on the radially r' wherein $R=1/10D$, forming a mean circle (48) having a diameter D' and a center on the center C wherein $D'=\frac{1}{2}D$, forming the leading edge (22) on a radial r extending radially from the center C and being 80° from the radial r', forming the heel circle (44) tangent to the radial r wherein the center C'' is on the mean circle (48) and $R'=\frac{1}{8}D$, forming the outside edge (24) on an arc A which is tangent to both the heel circle (44) and the tail edge circle (40) wherein the arc A has a radius R'' and $R''=\frac{3}{4}D$, and forming the inside edge (28) on an arc A' which is tangent to the tail edge circle and passes through the center C wherein the arc A' has a radius R''' and $R'''=\frac{3}{4}D$.

* * * * *